US009382778B2

(12) United States Patent
Frazier

(10) Patent No.: US 9,382,778 B2
(45) Date of Patent: Jul. 5, 2016

(54) BREAKING OF FRANGIBLE ISOLATION ELEMENTS

(71) Applicant: W. Lynn Frazier, Corpus Christi, TX (US)

(72) Inventor: W. Lynn Frazier, Corpus Christi, TX (US)

( * ) Notice: Subject to any disclaimer, the term of this patent is extended or adjusted under 35 U.S.C. 154(b) by 238 days.

(21) Appl. No.: 13/987,840

(22) Filed: Sep. 9, 2013

(65) Prior Publication Data

US 2015/0068730 A1 Mar. 12, 2015

(51) Int. Cl.
*E21B 33/14* (2006.01)
*E21B 34/06* (2006.01)

(52) U.S. Cl.
CPC ..... *E21B 34/063* (2013.01)

(58) Field of Classification Search
USPC ..... 166/367, 317, 377
See application file for complete search history.

(56) References Cited

U.S. PATENT DOCUMENTS

| | | | | |
|---|---|---|---|---|
| 3,831,680 | A | 8/1974 | Edwards | |
| 4,510,994 | A | 4/1985 | Pringle | |
| 4,658,902 | A | 4/1987 | Wesson | |
| 5,511,617 | A | 4/1996 | Snider | |
| 5,924,696 | A | 7/1999 | Frazier | |
| 6,026,903 | A | 2/2000 | Shy | |
| 6,155,350 | A | 12/2000 | Melenyzer | |
| 6,672,389 | B1 | 1/2004 | Hinrichs | |
| 7,044,230 | B2 | 5/2006 | Starr | |
| 7,210,533 | B2 | 5/2007 | Starr | |
| 7,287,596 | B2 | 10/2007 | Frazier | |
| 7,350,582 | B2 | 4/2008 | McKeachnie | |
| 7,455,116 | B2 | 11/2008 | Lembcke | |
| 7,806,189 | B2 | 10/2010 | Frazier | |
| 2007/0074873 | A1 | 4/2007 | McKeachnie | |
| 2007/0251698 | A1* | 11/2007 | Gramstad et al. | 166/376 |
| 2007/0284119 | A1 | 12/2007 | Jackson | |
| 2008/0271898 | A1 | 11/2008 | Turley | |
| 2009/0020290 | A1 | 1/2009 | Ross | |
| 2009/0056955 | A1 | 3/2009 | Slack | |
| 2009/0139720 | A1* | 6/2009 | Frazier | 166/295 |
| 2012/0125631 | A1 | 5/2012 | Entchev | |

* cited by examiner

*Primary Examiner* — Taras P Bemko
(74) *Attorney, Agent, or Firm* — G. Turner Moller

(57) ABSTRACT

A down hole pressure isolation tool is placed in a pipe string and includes a pair of pressure discs having one side that is highly resistant to applied pressure and one side that ruptures when much lower pressures are applied to it. The weak sides of the pressure discs face each other. In some embodiments, an upper disc is mounted for movement and restrained by a shearable connection. Upon the application of pressure to the tool, the connection shears allowing the upper disc to move into and collide with the lower disc thereby fracturing both discs and allowing pressure communication across the tool. In another embodiment, spurs carried by a sleeve fracture an upper disc in response to pressure delivered to an upper end of the tool.

11 Claims, 5 Drawing Sheets

BREAKING OF FRANGIBLE ISOLATION ELEMENTS

This application is based on Provisional Patent Application Ser. No. 61/744,435, filed Sep. 26, 2012, priority of which is claimed and which is incorporated herein by reference.

This invention relates to a technique for breaking a frangible isolation tool of a type run in a well to isolate a section of the well above the isolation tool from a section of the well below the tool.

BACKGROUND OF THE INVENTION

Isolation tools are used in hydrocarbon wells for a variety of purposes. They are commonly run in a well near the end of a tubing string and below a hydraulically set packer to isolate the packer from formation pressure and allow hydraulic operations above the isolation tool. They are run on the end of tubing strings or in order to pressure test the made up string. They are occasionally run on the bottom of casing strings before cementing the string in a well bore. Other uses will be apparent to those skilled in the art.

One type isolation tool comprises a pair of oppositely facing curved ceramic discs shown in U.S. Pat. No. 5,924,696. These discs have a strong side and a weak side, i.e. the convex side can resist considerably higher pressures than the concave side. These discs are arranged with the convex side facing toward the pressure to be resisted, i.e. the upper disc has its convex side facing upwardly and the lower disc has its convex side facing downwardly.

The upper ceramic disc disclosed in this patent is broken by dropping a weight or go-devil into the tubing string so this device is mainly usable in vertical wells.

It is desirable to provide an isolation tool comprising one or more ceramic domes which are usable in the horizontal or vertical leg of a hydrocarbon well. Such devices are shown in U.S. Pat. No. 7,806,189 and U.S. Printed Patent Application 20110017471 and application Ser. No. 12/800,622 which are incorporated herein by reference.

Other disclosures of interest are found in U.S. Pat. Nos. 3,831,680; 4,510,994; 4,658,902; 5,511,617; 6,155,350; 6,672,389; 7,044,230; 7,210,533 and 7,350,582 and U.S. Printed Patent Applications 20070074873; 20080271898; 20090056955; 20090020290 and 20120125631.

SUMMARY OF THE INVENTION

As used herein, upper refers to that end of the tool that is nearest the earth's surface, which is a vertical well would be the upper end but which in a horizontal well might be no more elevated than the other end. Similar, lower refers to that end of the tool that is furthest from earth's surface.

Three embodiments are disclosed. In two embodiments, the upper dome or disc is restrained by a shear device to withstand pressure to some value. When pressure from above exceeds the shear value, the upper dome or disc moves toward the lower disc and, in the process, disintegrates and causes the lower disc to shatter, either from shrapnel from the upper disc or from hydrostatic or dynamic pressure acting on the weak or concave side of the lower ceramic disc.

In the third embodiment, a sleeve mounted around the upper disc includes at least one spur on its upper end. When a shear device is broken by pressure from above, the sleeve moves downwardly around the upper disc so the spurs strike the convex side of the upper disc thereby fracturing it. This destroys the integrity of the upper disc which thereby fails. The lower disc shatters either from shrapnel from the upper disc or from the application of hydrostatic or dynamic pressure to the concave or weak side of the lower disc.

It is an object to provide an improved technique for removing frangible discs providing an isolating feature in a down hole well tool.

A further object is to provide an improved hydraulic technique for removing frangible discs in an isolation tool.

These and other objects and advantages will be apparent to those skilled in the art as this description proceeds.

DETAILED DESCRIPTION OF THE INVENTION

Figure 1:
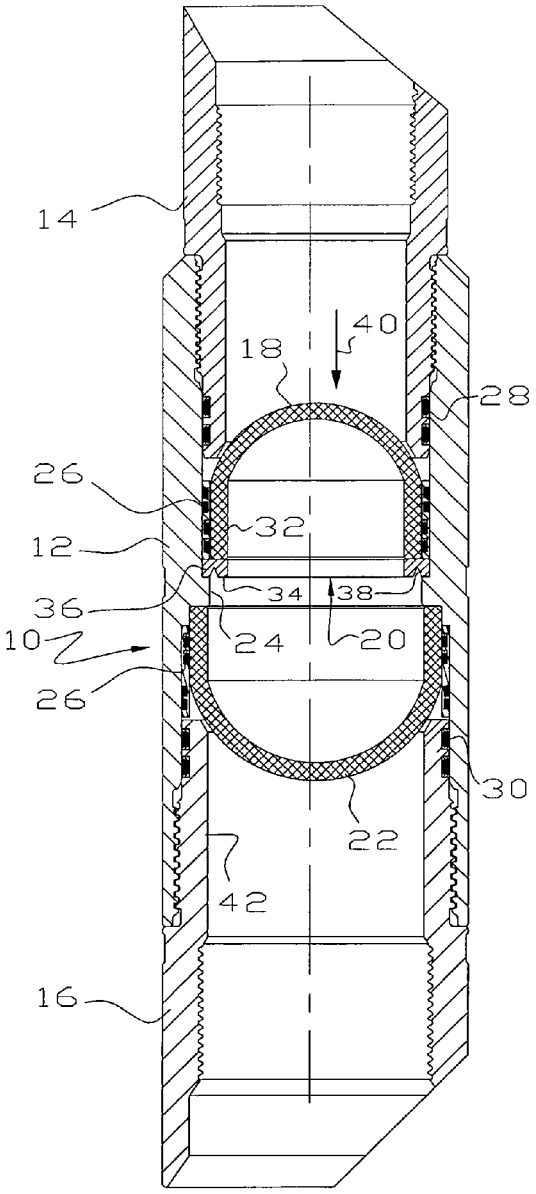
FIG. 1 is a vertical cross-sectional view of one embodiment showing the tool as it is run into a well.
Figure 2:
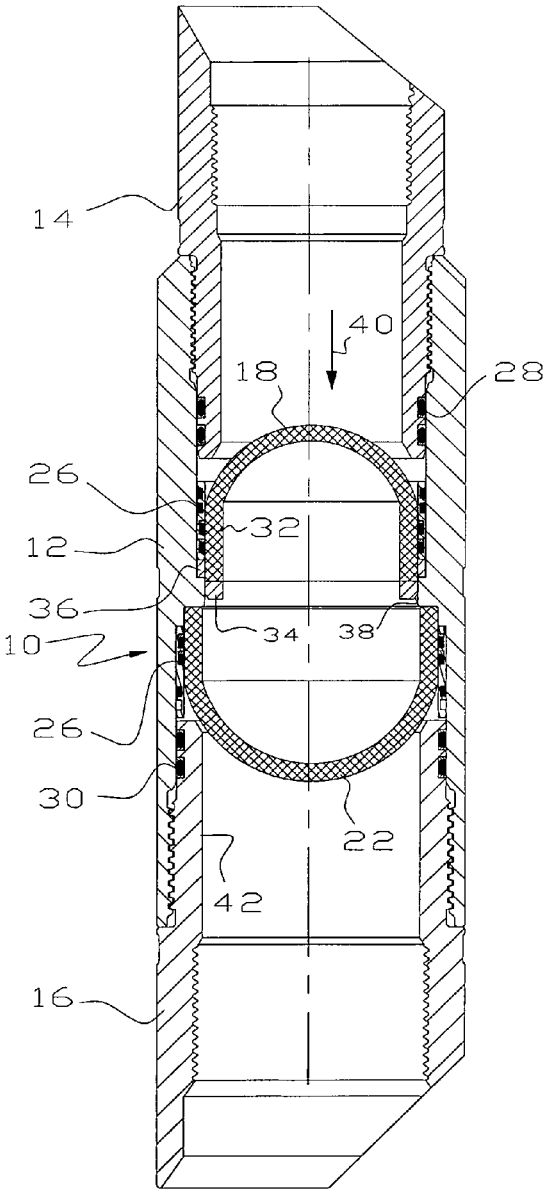
FIG. 2 is a view similar to FIG. 1 showing an intermediate arrangement of elements during removal of the isolating discs.
Figure 3:
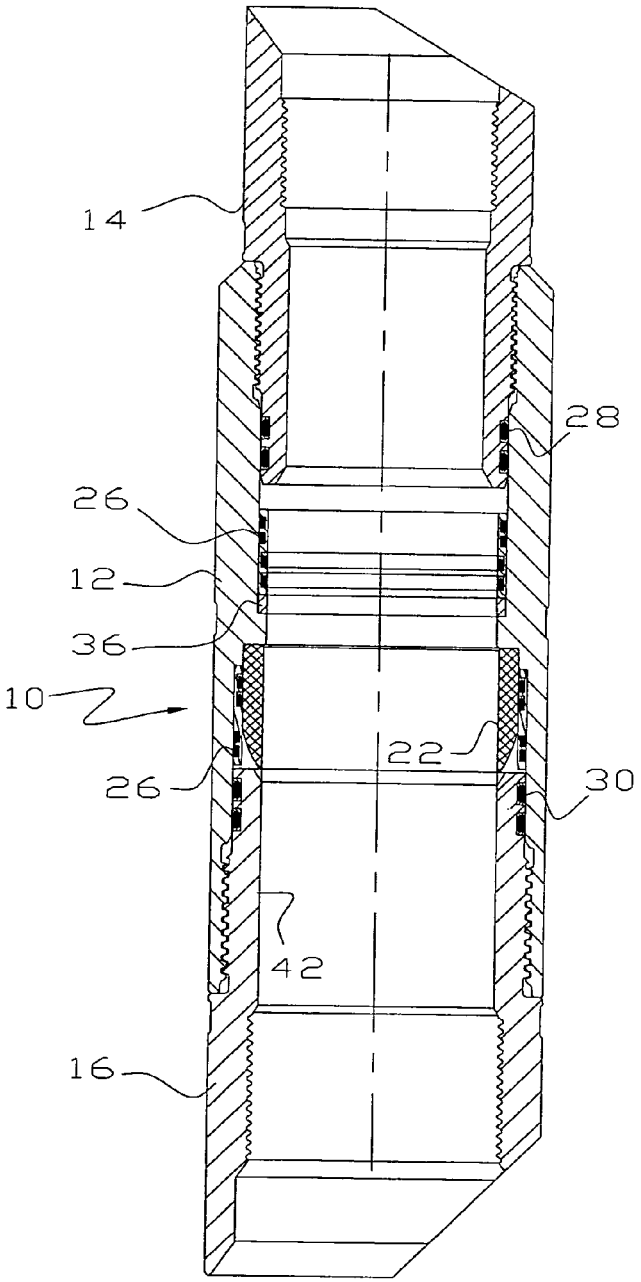
FIG. 3 is a view of the device of FIGS. 1-2 after the discs are broken and removed.

Referring to FIGS. 1-3, an isolation tool 10 may comprise a central body 12, an upper coupling 14 and a lower coupling 16. The body 12 and couplings 14, 16 captivate an upper disc or dome 18, a shearable connection such as a plate or ring 20 and a lower disc or dome 22 against a shoulder or ledge 24. A series of seals 26 may prevent leaks around the discs 18, 22 and a series of seals 28, 30 may prevent leaks between the body 12 and couplings 14, 16. The tool 10 may typically be attached to a stinger (not shown) on the bottom of a packer (not shown) so that the tubing string (not shown) to which the packer is attached is isolated from formation pressure. The packer may be hydraulically set or other operations conducted above the tool 10 without interference or difficulty caused by pressure on the outside of the tubing string. In the alternative, the tool 10 may be run on the bottom of a tubing string or liner in order to pressure test the made up string.

The discs 18, 22 may be ceramic discs of the type shown in U.S. Pat. No. 5,924,696 or in application Ser. No. 12/800,622 or of any other suitable type frangible members that have the property of being stronger in one direction than in another. Preferably, the upper disc 18 may include an elongate skirt 32 allowing multiple seals 26 on the exterior and preferably is of an O.D. that is receivable in the I.D. of the lower disc 22.

The shear plate 20 may include a lip 34 receiving the outside diameter of the upper disc 18 and a shoulder 36 abutting the bottom of the upper disc 18. A circumferential notch or other weakened portion 38 shears off when pressure from above, as suggested by the arrow 40, is sufficient. This allows the upper disc 18 to move toward the lower disc 22 as suggested in FIG. 2. The O.D. of the disc 18 may preferably be equal to or slightly less than the I.D. of the disc 22 so the collision between the upper and lower discs 18, 22 shatters at least the lower disc 22 and preferably both discs 18, 22. This produces a full opening passage 42 through the tool 10, i.e. the opening is as large as the minimum dimension through the central body 12 and couplings 14, 16 as shown in FIG. 3. Sometimes, the lower disc 22 is sheared off to leave the elongate skirt shown in FIG. 3 and sometimes the elongate skirt is destroyed so that all of the ceramic components of the discs 18, 22 are removed from the tool body 12 and either fall by gravity out of the tool 10 or are pumped out by the fluid being pumped through the tool 10.

In operation, the packer (not shown) may be set by pumping into the tubing string (not shown) until the pressure reaches a value sufficient to expand and set the packer against the inside of the casing string. Later, or immediately, pumping into the tubing string at an increased pressure reaches the shear value of the plate 20 whereupon the shear plate 20 fails releasing the upper disc 18 so the shear plate 20 and upper disc 18 move downardly into the lower disc 22 causing it to fail thereby providing communication across the tool 10 in preparation for additional operations. It is not completely clear whether the lower disc 22 is pulverized by the shear plate 20, shrapnel from the upper disc 18, the hydrostatic weight of liquid above the tool or the dynamic pressure resulting from pumping into the tool 10. In any event, the lower disc 22 fails more-or-less immediately upon failure of the shear plate 20 providing an unobstructed passage through the tool 10.

Figure 4:
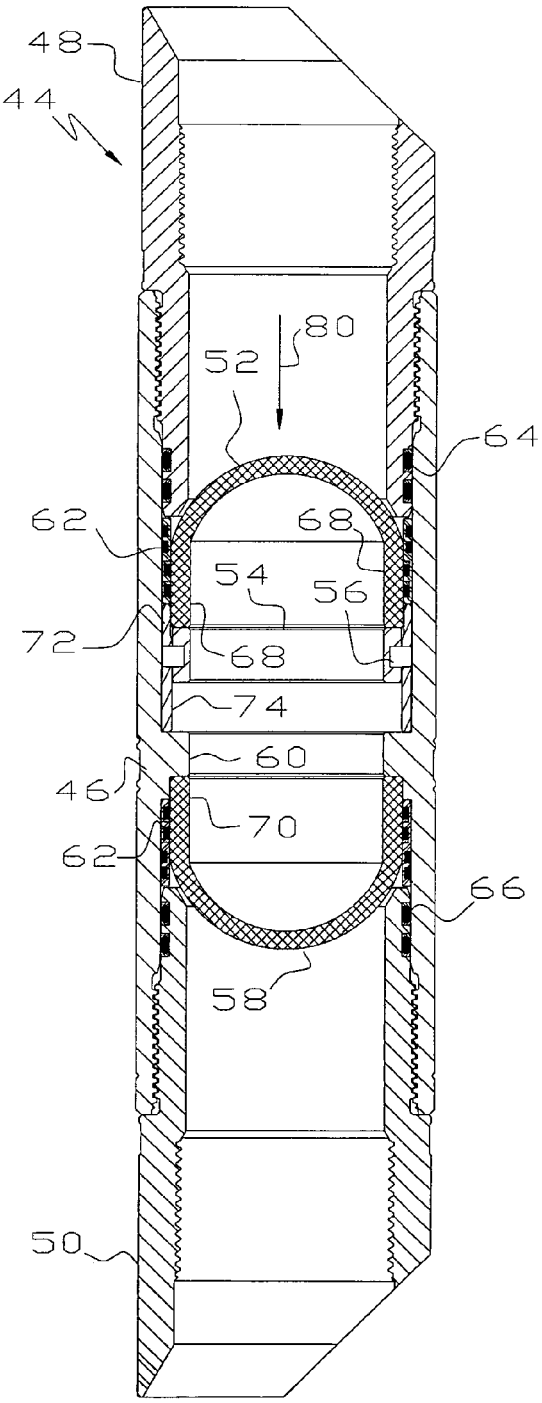
FIG. 4 is a vertical cross-sectional view of another embodiment showing the tool as it is run into a well.
Figure 5:
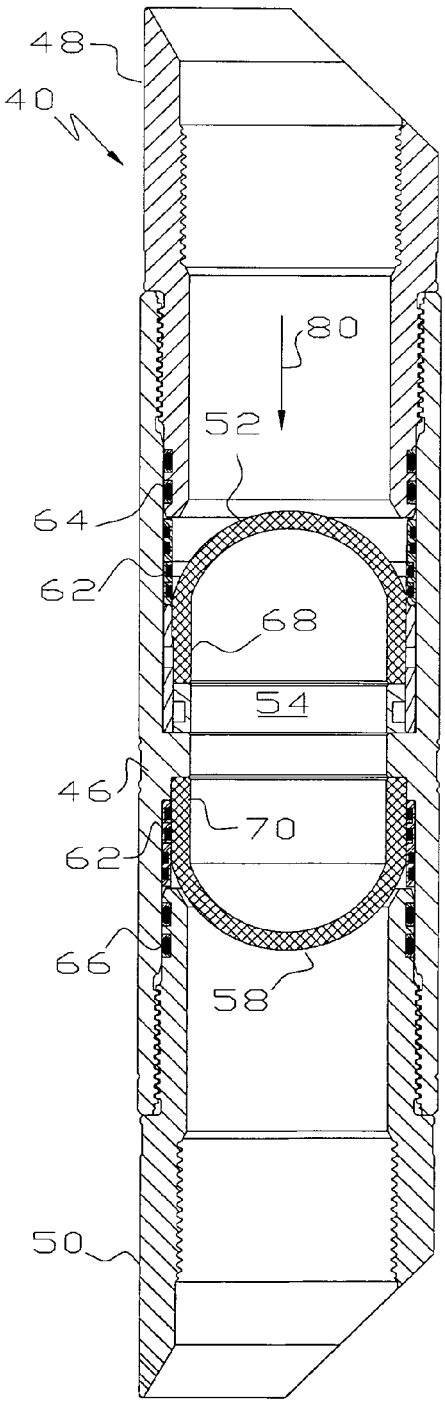
FIG. 5 is a view similar to FIG. 4 showing an intermediate arrangement of elements during removal of the isolating discs.
Figure 7:
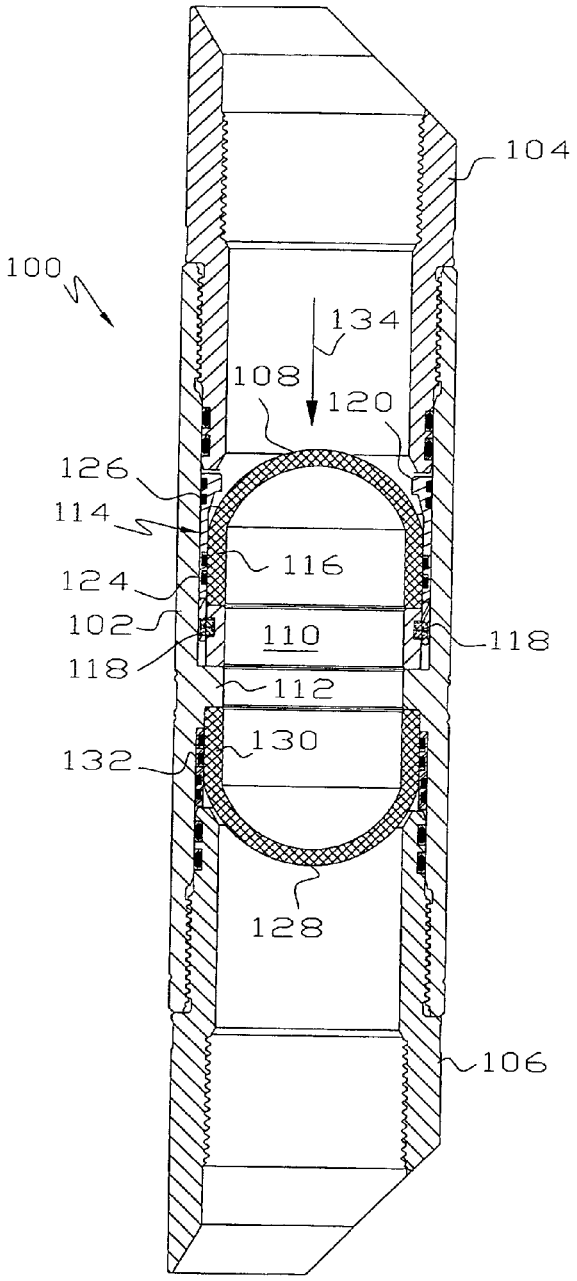
FIG. 7 is a vertical cross-sectional view of a third embodiment showing the tool as it is run into a well.
Figure 8:
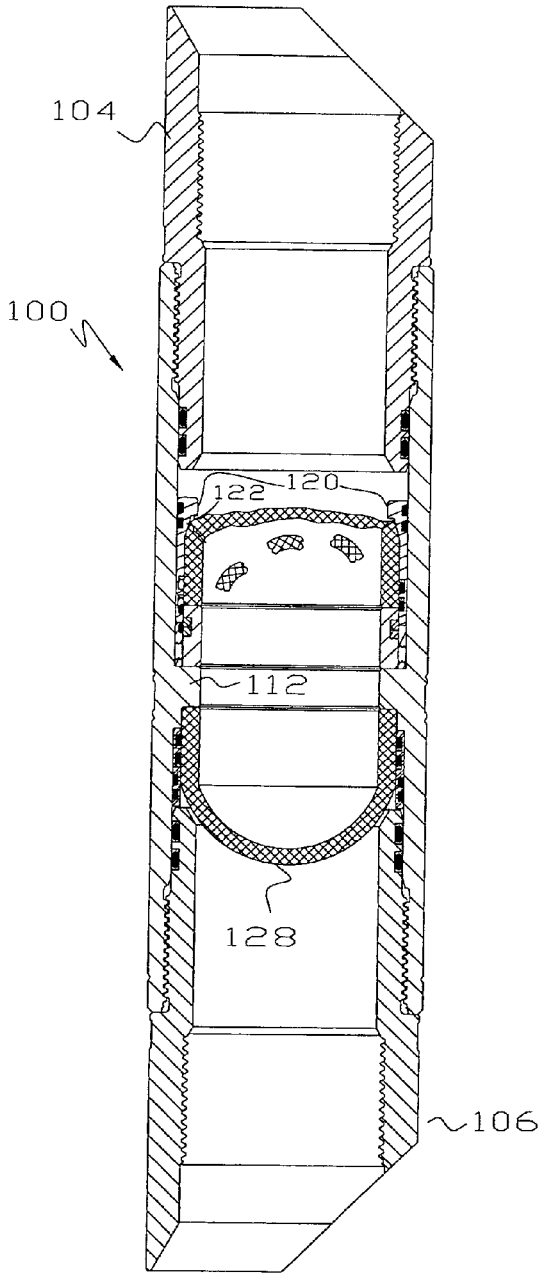
FIG. 8 is a view similar to FIG. 7 showing an intermediate arrangement of elements during removal of the isolating discs.
Figure 9:
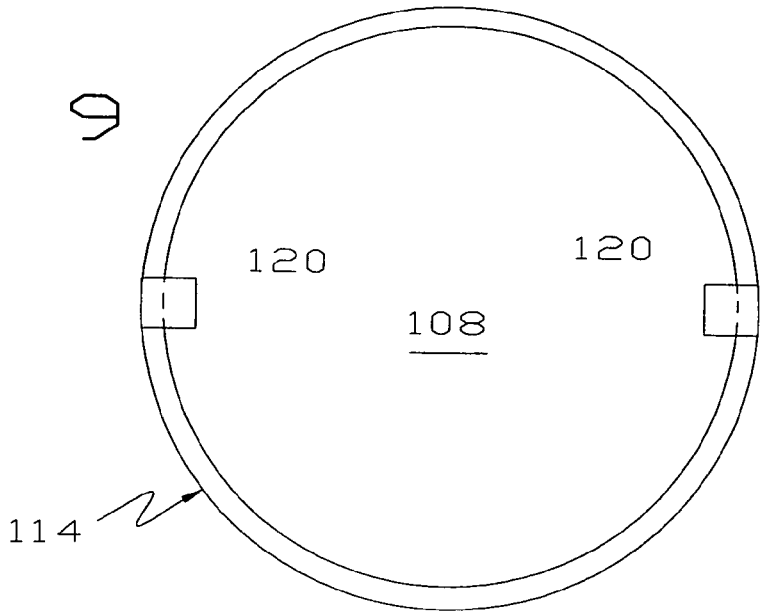
FIG. 9 is a top view of the upper disc and its surrounding sleeve.
Figure 10:
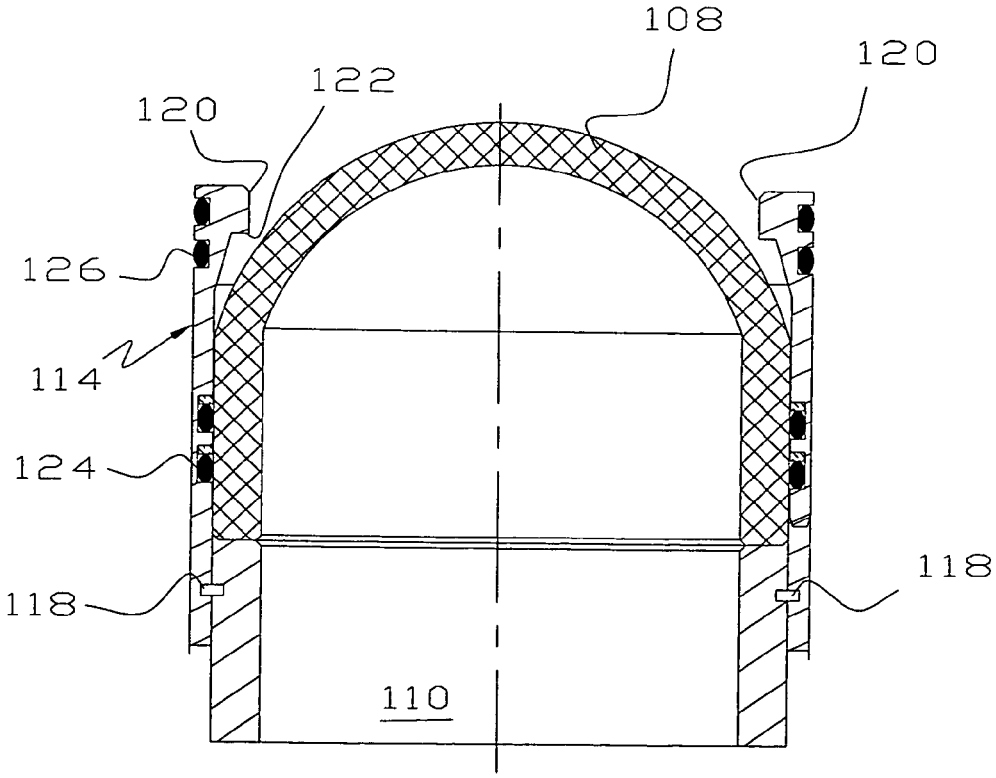
FIG. 10 is an enlarged cross-sectional view of the sleeve and upper disc in the embodiment of FIGS. 7-9.

Referring to FIGS. 4-5, an isolation tool 44 may comprise a central body 46, an upper coupling 48 and a lower coupling 50. An upper disc 52 is provided. A plate or ring 54 may provide a passage therethrough and may connect to the central body 46 by a shearable connection such as a shear pin 56 and, together with the upper coupling 48, captivates the upper disc 52. A lower disc 58 may be captivated between the lower coupling 50 and a ledge 60. A series of seals 62 prevents leaks around the discs 52, 58 and a series of seals 64, 66 may prevent leaks between the body 46 and couplings 48, 50. The tool 44 may typically be attached to a stinger (not shown) on the bottom of a packer (not shown) so that the tubing string (not shown) to which the packer is attached is isolated from formation pressure. The packer may be hydraulically set or other operations conducted without interference or difficulty caused by formation or hydrostatic pressure on the outside of the tubing string.

The discs 52, 58 may be ceramic discs of the type shown in U.S. Pat. No. 5,924,696 or in application Ser. No. 12/800,622 or of any other suitable type frangible members that have the property of being stronger in one direction than in another. Preferably, the upper and lower discs 52, 58 may include an elongate skirt 68, 70 allowing multiple seals 62 on the exterior thereof.

The upper disc 52 is mounted for movement inside a sleeve 72 having a passage 74 therein. The sleeve 72 may comprise part of the central body 46 or may be captivated thereto. The passage 74 may be configured to disintegrate the upper disc 52 upon movement of the upper disc 52. This may be accomplished in a variety of ways, such as tapering the passage slightly from an oversized upper end 76 to an internal diameter 78 that is substantially the same as or slightly smaller than the O.D. of the skirt 68. In the alternative, the sleeve 74 may include a protrusion or point or otherwise be of smaller dimension than the skirt 68 to stress the skirt 68 during movement of the upper disc 52. The lower edge of the disc 52 may rest on the upper edge. of the ring 54 so the shear pin 56 may initially constrain the upper disc 52 against movement downwardly. The ring 54 and shear pin 56 may preferably be of metal so the shear pin 56 operates in a conventional manner, i.e. it fails upon the application of a more-or-less predetermined or design force to free the ring 54 for downward movement. The concept is that when pressure applied as suggested by the arrow 80 is sufficient to shear the pin 56, the plate 54 moves allowing the upper disc 52 to move downwardly into the sleeve 72 and fail. Failure of the upper disc 52 causes the lower disc 58 to fail, either due to shrapnel from the upper disc 52 or from hydrostatic or dynamic pressure inside the tubing string thereby providing communication through the tool 44.

Exactly how the upper disc 52 fails may be subject to some argument because it is not completely clear whether the upper disc 52 shatters because it stops suddenly or whether it is squeezed by Constriction of the passage 74. Initially, the intact upper disc 52 moves downwardly into the sleeve 72 but as its lower end approaches the I.D. 78, the upper disc 52 fails. It may fail because of the sudden stop, either inside the sleeve 72 or against the plate 54. It may fail because of the hoop stress applied to the skirt 68 by the constriction of the passage 74. In any event, and without being bound by any theory, the upper disc 52 fails when it moves downwardly. This causes the lower disc 58 to fail. Tests run on a prototype show that the upper disc 52 shatters into relatively large pieces while the lower disc 58 is reduced to fine powder.

Figure 6:
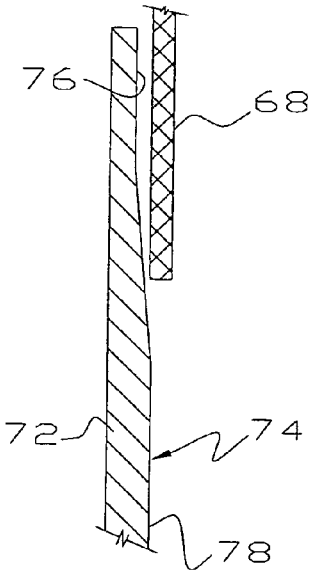
FIG. 6 is an enlarged partial view of a sleeve used in the embodiment of FIGS. 4-5.

The embodiment of FIGS. 4-6 has an advantage over the embodiment of FIGS. 1-3 because, for a predetermined tool O.D., the tool 44 can have a larger I.D. than the tool 10. The reason is that the embodiment of FIGS. 4-6 does not have to size the lower disc to be of larger I.D. than the O.D. of the upper disc. This is of considerable importance because the radial dimension in a well tool is at a premium, particularly when compared to axial dimensions. It will be seen that the upper discs 18, 52 of the tools 10, 44 fail as a consequence of their motion. In the embodiment of FIGS. 1-3, failure occurs because the upper disc 18 collides with the lower disc 22. In the embodiment of FIGS. 4-6 the upper disc 52 fails either because it moves into the constricted passage 74 or because it stops.

Referring to FIGS. 7-10, an isolation tool 100 may comprise a central body 102, an upper coupling 104 and a lower coupling 106. An upper disc 108 abuts a ring 110 which in turn abuts a ledge 112 provided by the central body 102. A sleeve 114 surrounds the disc 108 or at least a major portion of its skirt 116 and may initially be connected by one or more shear pins 118 to the ring 110. It will accordingly be seen in FIG. 7 that the sleeve 114 is spaced from the ledge 112. For purposes more fully apparent hereinafter, the sleeve 114 includes one or more spurs 120 having sharp points 122 which may be adjacent the convex side of the disc 108. One function of the spurs 120 is to constrain upward movement of the disc 108. The sleeve 114 includes suitable seals 124 sealing against the disc 108 and seals 126 sealing against the central body 102 thereby preventing leakage around the disc 108.

The tool 100 may also include a lower disc 128 having a skirt 130 sealed by multiple seals 132 against the central body. The lower disc 128 may be captivated against the ledge 112 by the coupling 106.

The tool 100 may typically be attached to a stinger (not shown) on the bottom of a packer (not shown) so that the tubing string (not shown) to which the packer is attached is isolated from formation pressure. The packer may be hydraulically set or other operations conducted without interference or difficulty caused by formation or hydrostatic pressure on the outside of the tubing string.

The discs 108, 128 may be ceramic discs of the type shown in U.S. Pat. No. 5,924,696 or in application Ser. No. 12/800,622 or of any other suitable type frangible members that have the property of being stronger in one direction than in another.

When it is desired to provide communication through the tool 100, pressure is applied from above as suggested by the arrow 134. When the pressure produces a force sufficient to shear the pin or pins 118, the sleeve 114 moves downwardly as suggested in FIG. 8 so the spurs 120 contact the convex side of the upper disc 108 thereby fracturing the disc 108. Failure of the disc 108 causes more-or-less immediate failure of the disc 128 thereby providing an open passage through the tool having a working I.D. which may be the same as the I.D. of the ledge 112 or the I.D. of the spurs 120.

It will be seen that an important advantage of the tool 100 is that the spurs 120 contact the upper disc 108 at a location near the junction of the curved top of the disc 108 and the skirt 116 more-or-less aligned with or outboard of the interior surface of the shoulder 112. This may be of advantage because the breaking mechanism does not utilize any radial space inside the passage through the shoulder 112. Tools used in hydrocarbon wells have a great deal of leeway in an axial direction, i.e. along the well axis, but very little leeway perpendicular to the well axis. In other words, taking up radial space in a well tool is very costly.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A down hole well isolation tool comprising a housing having a passage therethrough, an upper end, a lower end and having an axis extending through the upper and lower ends;

a first rupturable disc having a lower edge and a first side capable of withstanding a first pressure differential and a second side capable of withstanding a second pressure differential substantially greater than the first pressure, the second side of the first disc facing the upper housing end; and a second rupturable disc having a first side capable of withstanding a third pressure differential and a second side capable of withstanding a fourth pressure differential substantially greater than the third pressure differential, the second side of the second disc facing the lower housing end;

the first disc, in its entirety including the lower edge, being mounted for bodily movement axially toward the second disc from a position between the upper housing end and the second disc, the first disc being configured to move in response to a predetermined pressure applied to the upper end of the housing and collide with the lower disc and disintegrate both discs.

2. The down hole isolation tool of claim 1 further comprising a releasable connection mounting the first disc in the position whereupon application of a pressure sufficient to release the connection allows the first disc to move.

3. The down hole isolation tool of claim 2 wherein the releasable connection comprises a shearable element.

4. The down hole well isolation tool of claim 1 wherein the second disc includes an inner diameter and the first disc includes an outer diameter, the outer diameter of the first disc being smaller than the inner diameter of the second disc, the first disc being mounted for movement in a path into the second disc.

5. The down hole well isolation tool of claim 1 wherein the first disc includes a dome and a skirt extending from the dome and wherein the body includes a section having a passage therethrough, the first disc being mounted for movement into the passage, the passage having an upper end larger than the dimension of the skirt and a lower end no larger than the dimension of the skirt whereupon movement of the first disc into the lower passage end disintegrates the first disc.

6. The down hole well isolation tool of claim 5 wherein the body section comprises a sleeve captivated to the body.

7. The down hole well isolation tool of claim 5 wherein the passage is cylindrical and the passage dimension is an inner diameter, the skirt is cylindrical and the skirt dimension is an external diameter, the skirt external diameter being at least as large as the passage inner diameter.

8. The down hole well isolation tool of claim 5 wherein the first and second discs are ceramic dome shaped elements having a convex side and a concave side, the concave sides facing each other.

9. A down hole well isolation tool having a passage therethrough, the tool comprising a housing having upper and lower ends providing an axis through the tool and having therein a pair of pressure resistant rupturable discs temporarily blocking flow through the passage, each disc having a strong side more resistant to pressure applied in a first axial direction and a weak side less resistant to pressure applied in a second opposite axial direction, an upper of the discs having a lower edge and having its strong side facing an upper end of the housing and a lower of the discs having its strong side facing a lower end of the housing, the upper disc and the lower edge of the upper disc being mounted for axial movement between a first position and a second position closer to the lower disc than the first position and a connection temporarily securing the upper disc in the first position and releasable upon application of pressure from above thereby moving the upper disc toward the second position, the upper disc being shattered as a consequence of moving toward the second position, the upper disc being configured to collide with the lower disc during axial movement and disintegrate both discs in response to the collision.

10. The down hole isolation tool of claim 9 wherein the discs are ceramic dome shaped elements having a convex side and a concave side, the concave sides facing each other.

11. The down hole isolation tool of claim 9 wherein the connection comprises a shearable element.

* * * * *